US009675847B2

(12) United States Patent
Jahnigen et al.

(10) Patent No.: US 9,675,847 B2
(45) Date of Patent: Jun. 13, 2017

(54) SPORTS BALL AND METHOD OF MANUFACTURE

(71) Applicant: One World Play Project LLC, Napa, CA (US)

(72) Inventors: Timothy P. Jahnigen, Napa, CA (US); Jose C. Velasquez, Napa, CA (US); Rodger A. Bell, Napa, CA (US)

( * ) Notice: Subject to any disclaimer, the term of this patent is extended or adjusted under 35 U.S.C. 154(b) by 0 days.

(21) Appl. No.: 14/948,111

(22) Filed: Nov. 20, 2015

(65) Prior Publication Data

US 2016/0144243 A1 May 26, 2016

Related U.S. Application Data

(60) Provisional application No. 62/083,108, filed on Nov. 21, 2014.

(51) Int. Cl.

| | |
|---|---|
| ***A63B 37/02*** | (2006.01) |
| ***A63B 37/12*** | (2006.01) |
| ***A63B 45/00*** | (2006.01) |
| *A63B 37/06* | (2006.01) |
| *A63B 37/14* | (2006.01) |
| *A63B 102/20* | (2015.01) |

(52) U.S. Cl.

CPC ..... *A63B 37/12* (2013.01); *A63B 37/02* (2013.01); *A63B 45/00* (2013.01); *A63B 37/06* (2013.01); *A63B 37/14* (2013.01); *A63B 2102/20* (2015.10)

(58) Field of Classification Search

CPC ..... A63B 43/00; A63B 45/00; A63B 43/002; A63B 37/02; A63B 37/04; A63B 37/06; A63B 37/12; A63B 2037/065; A63B 2102/20; A63B 37/14

See application file for complete search history.

(56) References Cited

U.S. PATENT DOCUMENTS

| | | | | |
|---|---|---|---|---|
| 2,006,230 A * | 6/1935 | Dobbins | A63B 37/14 473/595 |
| 3,804,411 A * | 4/1974 | Hendry | A63B 43/06 273/DIG. 24 |
| 4,173,345 A * | 11/1979 | Pocklington | A63B 37/0003 264/274 |
| 4,454,253 A * | 6/1984 | Murphy | C08G 18/165 264/46.9 |
| 4,463,951 A * | 8/1984 | Kumasaka | A63B 37/02 273/DIG. 5 |
| 4,660,830 A * | 4/1987 | Tomar | A63B 45/00 264/161 |

(Continued)

FOREIGN PATENT DOCUMENTS

| | | |
|---|---|---|
| RU | 2089252 C1 * | 9/1997 |
| RU | 2089252 C1 | 9/1997 |

(Continued)

*Primary Examiner* — Steven Wong

(74) *Attorney, Agent, or Firm* — West & Associates, A PC; Stuart J. West

(57) ABSTRACT

A sports ball comprising an inner core with a plurality of nubs on its exterior surface, and an outer shell comprising two hemispheres that surround the inner core such that the plurality of nubs contact the inner surfaces of the outer shell's inner cavity. The outer core can comprise a cross-linked closed-cell foam such that the sports ball can be more durable and softer than conventional balls normally used for the same sport.

6 Claims, 5 Drawing Sheets

(56) References Cited

U.S. PATENT DOCUMENTS 5,131,665 A * 7/1992 Myers ..... A63B 43/002 473/569
5,251,908 A * 10/1993 Myers ..... A63B 43/002 473/607
5,433,438 A * 7/1995 Gilman ..... A63B 37/02 473/596
6,432,000 B1 8/2002 Nesbitt et al.
6,666,782 B1 * 12/2003 Wu ..... A63H 33/22 446/242
6,719,653 B1 * 4/2004 Nesbitt ..... A63B 37/02 473/600
7,247,107 B1 * 7/2007 Bedwell ..... A63B 37/02 473/595
2002/0025866 A1 * 2/2002 Thomas ..... A63B 37/14 473/598
2004/0198535 A1 * 10/2004 Cavallaro ..... A63B 45/00 473/371
2005/0037867 A1 * 2/2005 Ninomiya ..... A63B 37/0003 473/371
2005/0079936 A1 * 4/2005 Litchfield ..... A63B 37/12 473/596
2008/0248898 A1 * 10/2008 Morgan ..... A63B 37/0003 473/373
2009/0069122 A1 3/2009 Laliberty
2009/0312120 A1 * 12/2009 Sullivan ..... A63B 37/0003 473/354
2012/0094784 A1 * 4/2012 Hebert ..... A63B 37/0003 473/374

FOREIGN PATENT DOCUMENTS

RU 2308998 C1 * 10/2007
RU 2308998 C1 10/2007

* cited by examiner

SPORTS BALL AND METHOD OF MANUFACTURE

CLAIM OF PRIORITY

This Application claims priority under 35 U.S.C. §119(e) from earlier filed U.S. Provisional Application Ser. No. 62/083,108, filed Nov. 21, 2014, which is hereby incorporated by reference.

BACKGROUND

Field of the Invention

The present disclosure relates to the field of sports equipment, particularly sports balls such as cricket balls.

Background

Sports balls are used by players around the world to play many types of games. While most sports balls are spherical, many differ in properties such as size, structure, and materials. Many sports balls are specifically designed and manufactured to be suitable for playing a particular sport.

For example, cricket is a popular game played around the world. Conventional cricket balls have a hard inner core made of cork or rubber surrounded by a leather outer cover. Many are made to conform to specific standards governing their weight and/or size. For instance, standards for the balls used for professional men's cricket require the ball to be between 5.5 oz. and 5.75 oz., with a circumference between 224 mm and 229 mm. This traditional structure leads to a hard and heavy ball that can travel very quickly through the air.

While such cricket balls can perform as intended for a cricket match, they can also be very dangerous to players due to their hardness and the speed at which they can travel. Injuries and even death can occur when players are hit with conventional cricket balls. As such, professional and organized players often wear protective equipment during matches to avoid injury. Unfortunately, many players play cricket casually without protective gear, such as in street matches or when they cannot afford protective gear, increasing the risk of injury.

Many players also use other types of balls that are more affordable and/or can be more readily obtained than conventional cricket balls. For example, casual players in street matches often use a tennis ball in place of a conventional cricket ball. However, a tennis ball is generally bouncier, softer, lighter, and less dense than traditional cricket balls. These differing qualities can cause tennis balls to perform very differently than regular cricket balls when they are thrown or hit during cricket matches, thereby changing how the game is played.

Some players apply electrical or other adhesive tape to the exterior of a tennis ball in an attempt to make it harder and smoother, to better approximate how a conventional cricket ball performs. However, such "tape balls" can still perform differently than conventional cricket balls during matches.

Other players practice or play with used cricket balls. However, conventional cricket balls can degrade quickly during play, with their surfaces becoming worn down. Worn down areas on the exterior of a cricket ball can alter the ball's normal trajectory through the air. As such, using old and degraded cricket balls can lead to unpredictable performance.

What is needed is a cricket ball made of materials that make it more durable than conventional cricket balls, which also being lighter and softer than conventional cricket balls such that the risk of injury to players is reduced.

DETAILED DESCRIPTION

Figure 1:
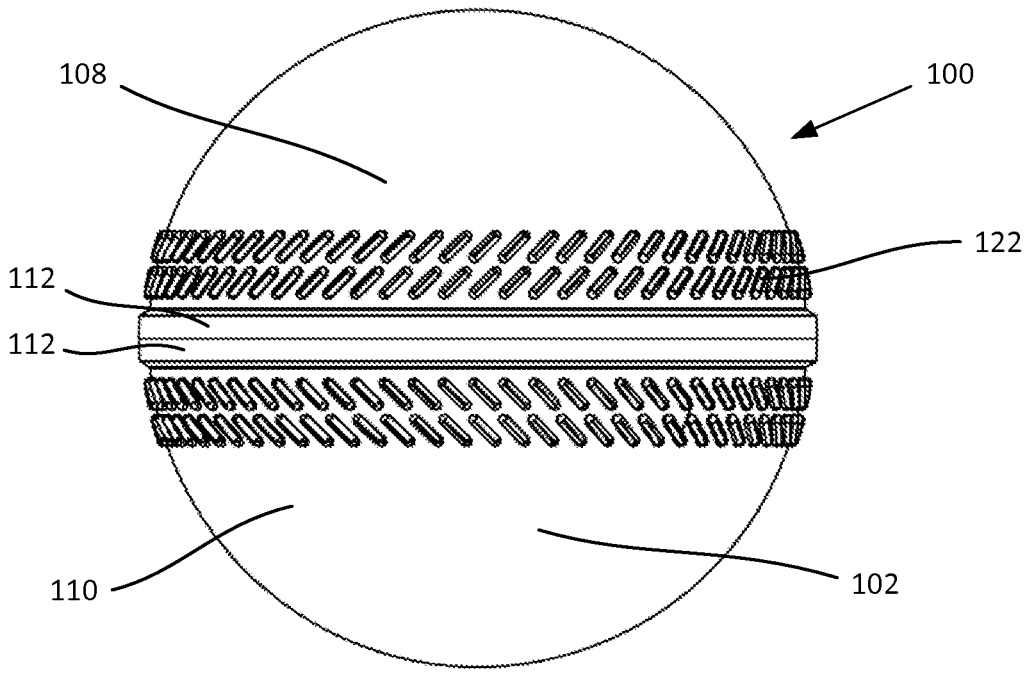
FIG. 1 depicts a side view of an embodiment of a sports ball.
Figure 2:
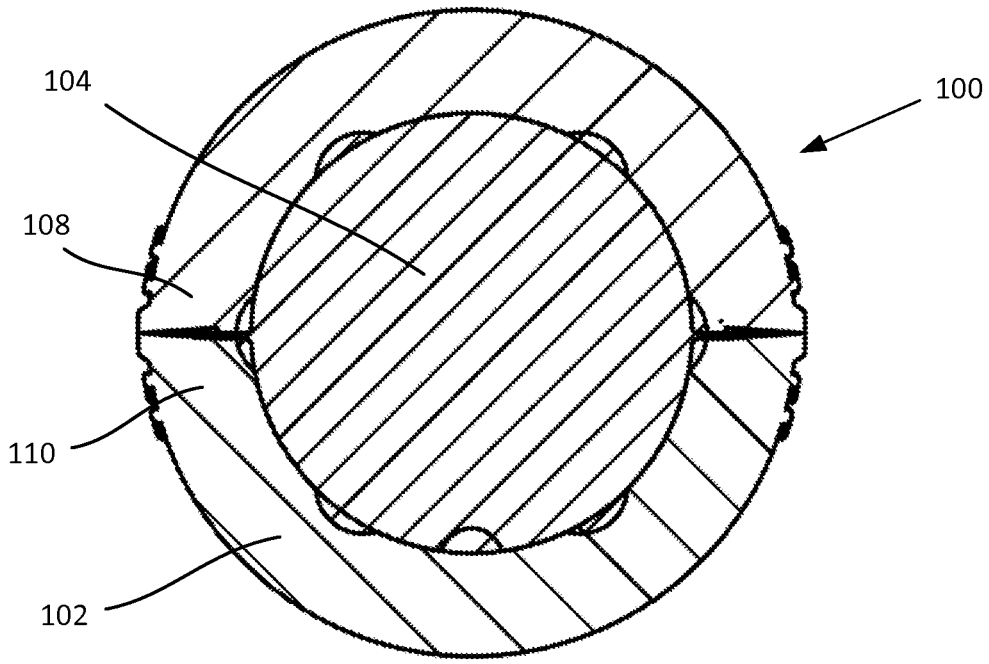
FIG. 2 depicts a cross sectional side view of an embodiment of a sports ball.

FIG. 1 depicts a side view of an embodiment of a sports ball 100, and FIG. 2 depicts a cross sectional side view of an embodiment of a sports ball 100. A sports ball 100 can comprise an outer shell 102 and an inner core 104. The outer shell 102 can be a substantially spherical body surrounding and defining an interior cavity, and the inner core 104 can be housed within the outer shell's interior cavity, as shown in FIG. 2.

In some embodiments, the outer shell 102 can comprise cross-linked closed-cell foam. By way of a non-limiting example, the outer shell 102 can comprise ethylene-vinyl acetate (EVA) foam. In alternate embodiments the outer shell 102 can comprise any other type of material, such as any other type of foam, rubber, vinyl, plastic, leather, polymer, and/or elastomeric material.

Figure 3:
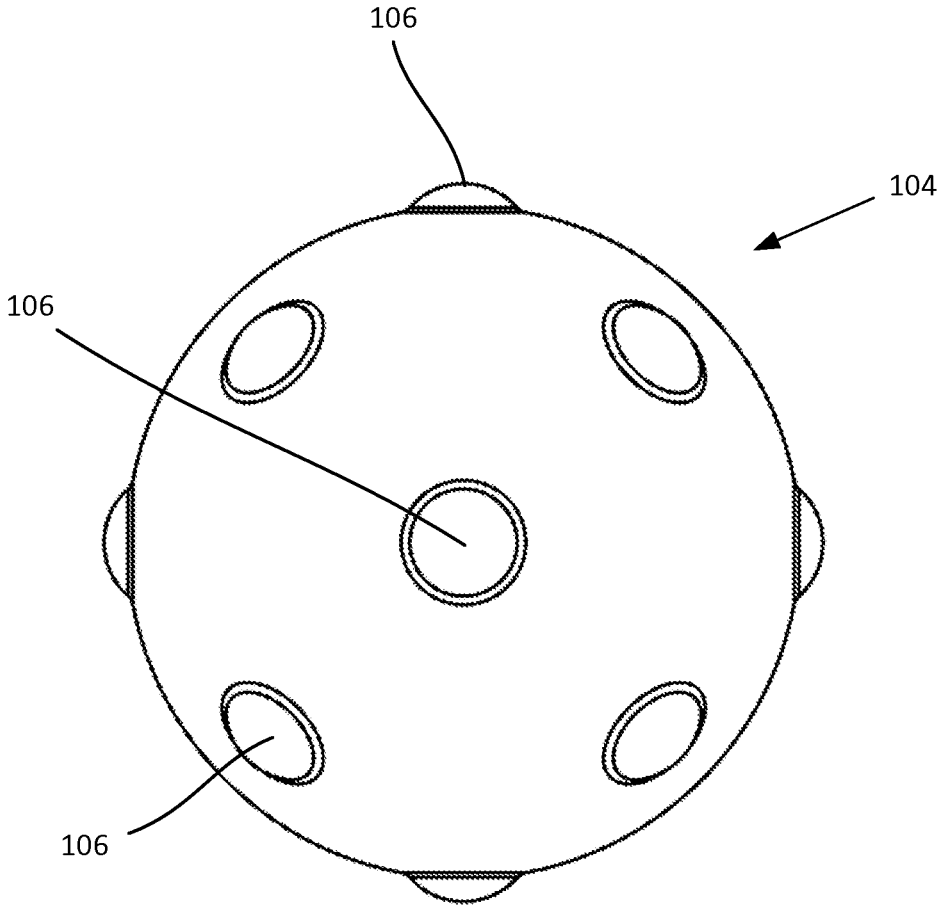
FIG. 3 depicts a side view of an embodiment of an inner core.

FIG. 3 depicts a side view of an embodiment of the inner core 104. The inner core 104 can be a substantially spherical body. In some embodiments, the inner core 104 can comprise a material that is harder than the material comprising the outer shell 102. By way of a non-limiting example, in some embodiments the inner core 104 can comprise rubber. In other embodiments, the inner core 104 can comprise plastic, cork, wood, metal, or any other material. In alternate embodiments, the inner core 104 can comprise a material that is softer than the material comprising the outer shell 102, a material that has the same hardness as the outer shell 102, or can be made of the same material as the outer shell. In yet other embodiments, the inner core 104 can be absent and the outer shell's interior cavity can be empty.

In some embodiments the inner core 104 can have a plurality of nubs 106, as shown in FIG. 3. The nubs 106 can be protrusions extending out of the exterior surface of the inner core 104. By way of a non-limiting example, in some embodiments the nubs 106 can be curved or partially spherical protrusions extending from the spherical surface of the inner core 104. In some embodiments the nubs 106 can be integral with the rest of the inner core 104, such that the nubs 106 and inner core 104 are formed as one piece. In other embodiments the nubs 106 can be separate components coupled with the inner core 104.

In some embodiments the nubs 106 can be positioned at regular intervals around the entirety of the substantially spherical exterior surface of the inner core 104. By way of a non-limiting example, in some embodiments four nubs 106 can be spaced evenly around the circumference of the inner core 104 along an xy plane, an xz plane, and/or a yz plane in a Cartesian coordinate system, and additional nubs 106 can be spaced more closely together around the circumference of the inner core 104 along planes oriented 45 degrees relative to the xy plane, xz plane, and/or yz plane, as shown in FIG. 3. In alternate embodiments the nubs 106 can be randomly arranged around the exterior surface of the inner core 104, or be arranged in any other design or pattern around some or all of the substantially spherical exterior surface of the inner core 104.

The nubs 106 can press and/or rest against the interior surface of the outer shell 102 when the inner core 104 is housed within the outer shell's interior cavity, such that friction and other interactions between the nubs 106 and the interior surface of the outer shell 102 at least partially prevents the inner core 104 from rotating, wobbling, or otherwise moving relative to the outer shell 102. As shown in FIG. 2, the nubs 106 can press into the interior surface of the outer shell 102, and because the nubs 106 and inner core 104 can be made of a harder material than the outer shell 102, the outer shell's interior surface can deform around the nubs 106.

The outer shell 102 and inner core 104 can be manufactured such that the outer diameter of the inner core 104 and the inner diameter of the outer shell 102 are substantially the same, such that the exterior surface of the inner core 104 can directly contact the surface of the outer shell's inner cavity when the inner core 104 is housed within the outer shell 102. However, in some embodiments or situations manufacturing tolerances can allow the outer shell 102 or inner core 104 to be made slightly larger or smaller, leading to a gap between the surface of the inner core 104 and the surface of the outer shell's inner cavity. As such, the nubs 106 can be formed with a height such that the nubs 106 fill the gap between the inner core 104 and the outer shell 102.

In some embodiments, the minimum height of the nubs 106 sufficient to fill a gap between the inner core 104 and the outer shell 102 can be determined by the diameter of the outer shell's inner cavity multiplied by the manufacturing tolerance percentage for the outer shell's inner diameter divided by two, plus the outer diameter of the inner core 104 multiplied by the manufacturing tolerance percentage for the inner core's outer diameter divided by two. By way of a non-limiting example, in some embodiments the outer shell 102 can be manufactured such that its inner cavity has a diameter of 1.75 inches, with an allowable variance of 4%, leading to an inner diameter of 1.75 inches plus or minus 0.035 inches. Similarly, in this embodiment the inner core 104 can be manufactured such that its outer surface has a diameter of 1.75 inches, with an allowable variance of plus or minus 0.005 inches. In this example, the maximum diameter of the outer shell's inner cavity can thus be 1.785 inches, while the minimum diameter of the inner core 104 can be 1.745 inches, leading to a possible gap of 0.04 inches. As such, in this example the nubs 106 can be manufactured to extend beyond the diameter of the inner core at more than 0.04 inches, such as a height of 0.06 inches, in order to ensure that the tips of the nubs 106 contact the inner surface of the outer shell 102. It should be noted that these measurements and tolerances are exemplary only, and in alternate embodiments the outer shell 102, inner core 104, and nubs 106 can be manufactured with any other desired dimensions or tolerances.

In alternate embodiments springs or other compressible components can be present on the inner core 104 in place of the nubs 106, such that the springs can press against the inner surface of the outer shell 102 to assist in keeping the inner core 104 in place relative to the outer shell 102. In other embodiments non-compressible components, such as posts, spikes, or other types of protrusions or extensions, can be present on the inner core 104 in place of the nubs 106, such that the non-compressible components can push against and deform the inner surface of the outer shell 102 to assist in keeping the inner core 104 in place relative to the outer shell 102. In still other embodiments the nubs 106 can be absent. In some embodiments, adhesives or other coupling mechanisms can be used in place of, or in addition to, the nubs 106 to keep the inner core 104 in place relative to the outer shell 102.

Figure 4:
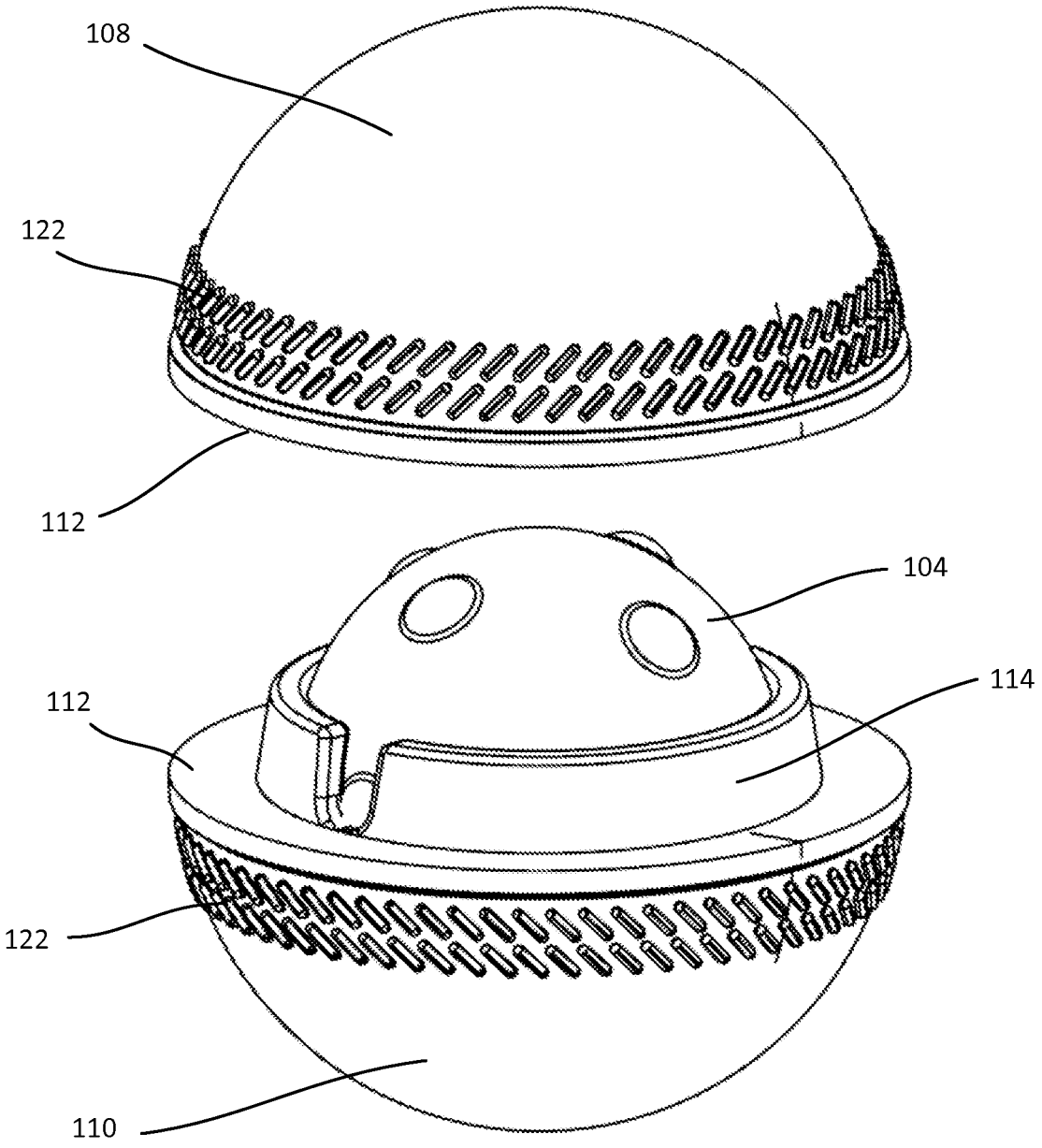
FIG. 4 depicts an exploded view of an embodiment of a sports ball.

FIG. 4 depicts an exploded view of an embodiment of a sports ball 100. In some embodiments, the outer shell 102 can comprise a first hemisphere 108 coupled with a second hemisphere 110 to surround and enclose the inner core 104. The first hemisphere 108 and the second hemisphere 110 can each be a member formed with a concave dome shape, with a circular peripheral edge 112. As shown in FIG. 4, the inner core 104 can be housed within the concave cavities of the first hemisphere 108 and the second hemisphere 110, and the peripheral edges 112 of the first hemisphere 108 and the second hemisphere 110 can be coupled with one another to enclose the outer shell 102 around the inner core 104.

In some embodiments, the peripheral edges 112 can be coupled with one another using an adhesive or bonding agent, such as contact cement. In some embodiments, inner surfaces of the peripheral edges 112 that will be in direct contact can be roughened prior to applying the adhesive or bonding agent. Roughing these surfaces can increase the surface area to which the adhesive or bonding agent can adhere, which can in some situations increase the strength of the resulting bond. By way of a non-limiting example, when the first hemisphere 108 and the second hemisphere 110 are made of EVA foam, their peripheral edges 112 can be roughened to break the skin of the EVA foam, contact cement can be applied to the roughened surfaces, and the roughened surfaces of the peripheral edges 112 of the first hemisphere 108 and the second hemisphere 110 can be bonded together. In alternate embodiments the surfaces of the first hemisphere 108 and the second hemisphere 110 that will be joined together can be otherwise prepared prior to applying an adhesive or bonding agent, such as by applying a liquid primer. In still other embodiments an adhesive or bonding agent can be applied directly to the surfaces of the first hemisphere 108 and the second hemisphere 110 without prior preparation, or the first hemisphere 108 and the second hemisphere 110 can be joined together with any other coupling mechanism.

Figure 5:
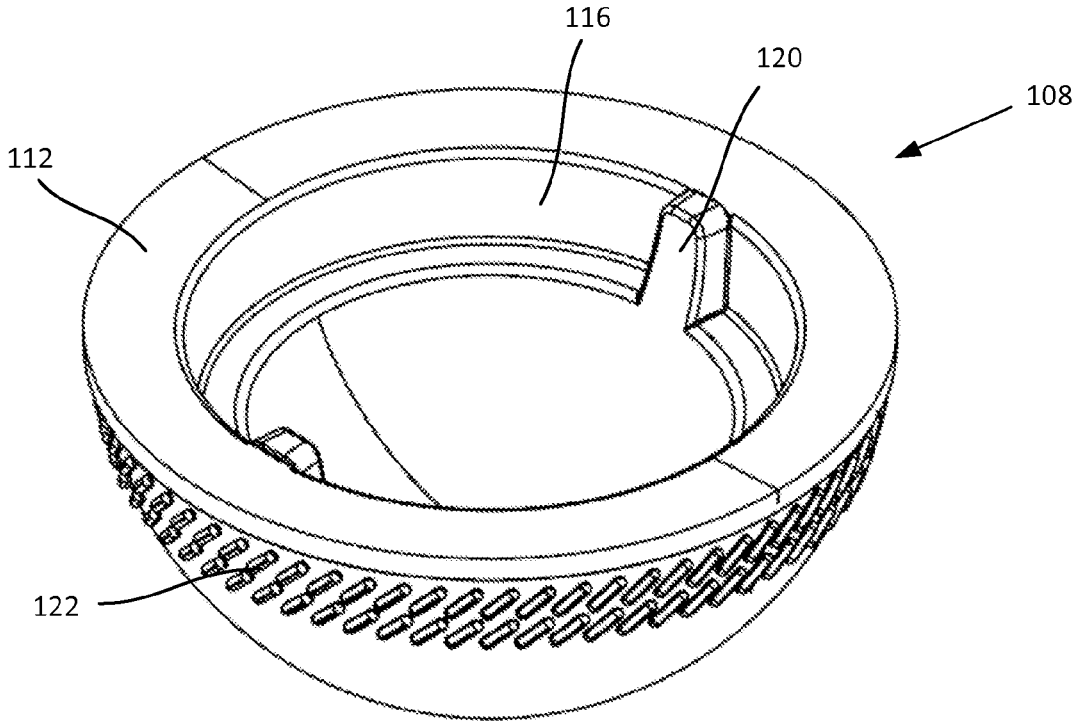
FIG. 5 depicts an embodiment of a first hemisphere.
Figure 6:
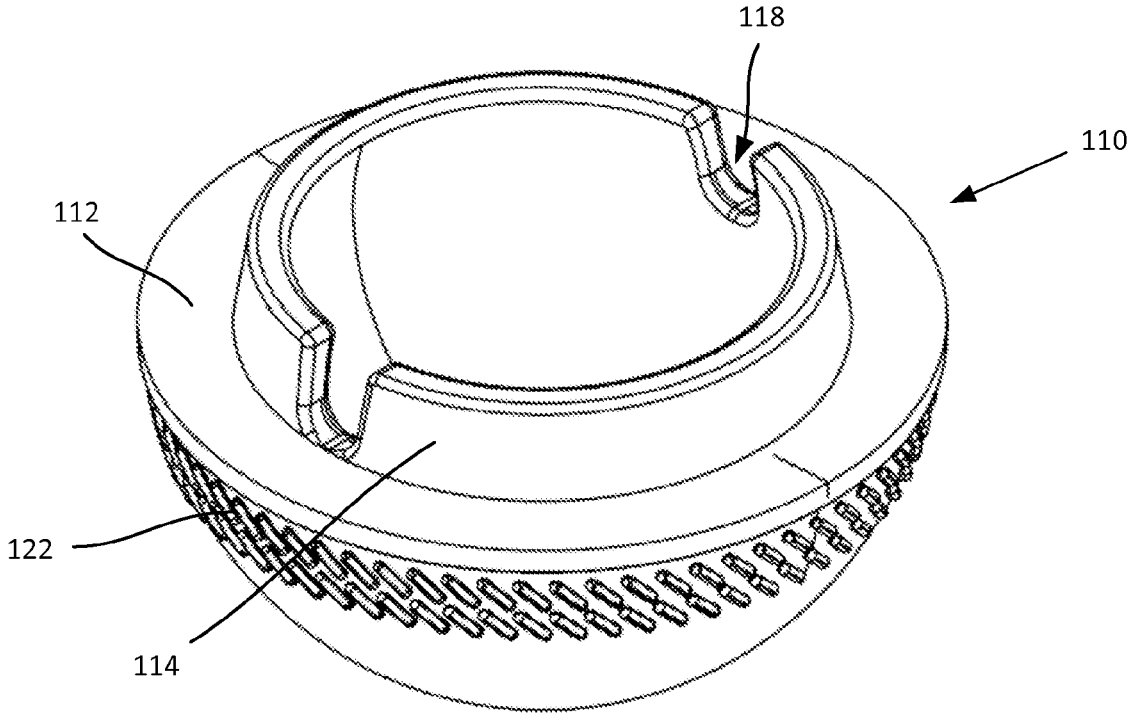
FIG. 6 depicts an embodiment of a second hemisphere.

FIG. 5 depicts an embodiment of a first hemisphere 108, and FIG. 6 depicts an embodiment of a second hemisphere 110. In some embodiments, the second hemisphere 110 can comprise a flange 114 that extends out of its peripheral edge 112. The flange 114 can be a wall that is thinner than the thickness of the second hemisphere 110, and can extend out of the peripheral edge 112 proximate to the concave inner surface of the second hemisphere 110, as shown in FIG. 5. In these embodiments the first hemisphere 108 can be formed with a flange indentation 116 within its concave inner surface, as shown in FIG. 6. The flange indentation 116 of the first hemisphere 108 can be configured to receive the flange 114 of the second hemisphere 110. In some embodiments an adhesive or bonding agent, such as contact cement, can be applied to directly adjacent surfaces of the flange 114 and flange indentation 116 when the first hemisphere 108 relative to the second hemisphere 110 are coupled together.

In some embodiments the flange 114 and flange indentation 116 can have one or more corresponding cutouts 118 and protrusions 120, as shown in FIGS. 5 and 6. The protrusions 120 can fit into the cutouts 118 when the first hemisphere 108 is coupled with the second hemisphere 110, and their interaction can at least partially prevent rotation of the first hemisphere 108 relative to the second hemisphere 110. In alternate embodiments the cutouts 118 and protrusions 120 can be absent.

As shown in FIG. 4, the inner core 104 can be inserted into the inner concave cavity of the second hemisphere 110, within the flange 114. In some embodiments the flange 114 can be angled inward as it extends upward from the second hemisphere's peripheral edge 112, such that it can assist in holding the inner core 104 in place. In some embodiments nubs 106 of the inner core 104 can be fit into cutouts 118 in the flange, as shown in FIG. 4. Fitting one or more nubs 106 within cutouts 118 can assist in maintaining the inner core's position relative to the outer shell 102.

In alternate embodiments, the outer shell 102 can comprise a single piece formed or molded around the inner core 104, or a plurality of pieces coupled together around the inner core 104. By way of a non-limiting example, the outer shell 102 can comprise four half-hemispheric pieces coupled together to form a full sphere around the inner core 104. By way of another non-limiting example, the outer shell 102 can comprise two substantially figure-8 shaped pieces that can be fit together to form a full sphere, similar to the outer pieces of a baseball or softball.

Returning to FIG. 1, in some embodiments the exterior surface of the outer shell 102 can have one or more textured areas 122. The textured areas 122 can be areas or patterns on the surface of the outer shell 102, such as a series or pattern of raised protrusions, indentations, or textures. In some embodiments the textured areas 122 can be shaped and positioned similar to the raised seams of a conventional cricket ball, baseball, or softball. By way of a non-limiting example, in some embodiments the exterior surface of the outer shell 102 can have one or more rings of raised protrusions that encircle the exterior surface of the outer shell 102 around an equator proximate to the joint between the first hemisphere 108 and the second hemisphere 110, emulating the seams of a cricket ball.

In some embodiments the joint between the first hemisphere 108 and the second hemisphere 110 can have raised exterior surface relative to the rest of the outer shell's exterior surface. By way of a non-limiting example, the circular peripheral edges 112 of the first hemisphere 108 and the second hemisphere 110 can extend beyond the outer surface of the rest of the first hemisphere 108 and the second hemisphere 110, such that the coupled peripheral edges 112 are raised on the exterior of the outer shell 102 between the textured areas 122, as shown in FIG. 1. In alternate embodiments, the joint between the first hemisphere 108 and the second hemisphere 110 can be flush with the rest of the outer shell's exterior surface.

In embodiments in which the outer shell 102 is made of a cross-linked closed-cell foam, the cross-linked closed-cell foam can make the outer shell 102 waterproof, non-toxic, anti-bacterial, and/or non-absorbent. The cross-linked closed-cell foam can also make the sports ball 100 softer and/or more durable than other types of balls. By way of a non-limiting example, a sports ball 100 with an outer shell 102 made of cross-linked closed-cell foam made in the size and shape of a cricket ball can be more softer and/or more durable than conventional cricket balls, such that the sports ball 100 can be used as a longer lasting and safer alternative to conventional cricket balls that degrade quickly and pose injury risks due to their hard exteriors.

Figure 7:
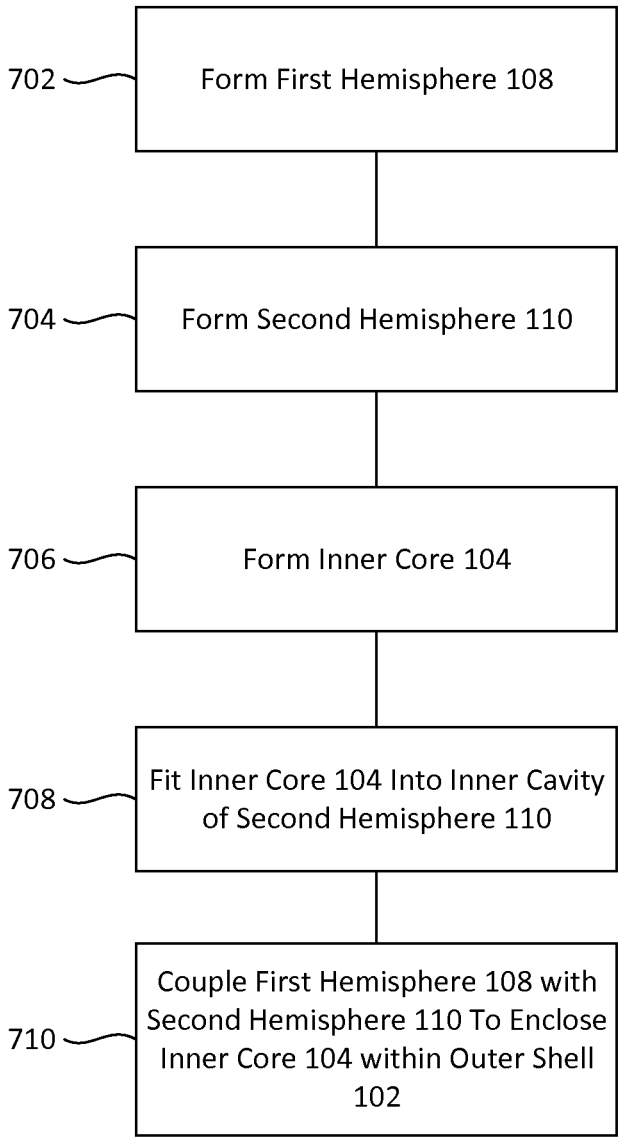
FIG. 7 depicts a flowchart for an exemplary method of making a sports ball.

FIG. 7 depicts a flowchart for an exemplary method of making a sports ball 100.

At step 702, a first hemisphere 108 can be formed or provided. In some embodiments the first hemisphere 108 can be formed of cross-linked closed cell foam, such as by injection molding.

At step 704, a second hemisphere 110 can be formed or provided. In some embodiments the second hemisphere 110 can be formed of cross-linked closed cell foam, such as by injection molding.

At step 706, an inner core 104 can be formed or provided. In some embodiments the inner core 104 can be formed of rubber, such as through molding or casting.

In various embodiments steps 702 through 706 can be performed simultaneously, asynchronously, or in any order.

At step 708, the inner core 104 can be fit into the inner cavity of the second hemisphere 110. In some embodiments the inner core 104 can be fit within a flange 114 of the second hemisphere 110, such that the flange 114 can assist in keeping the inner core 104 in place. In some embodiments, the inner core 104 can be oriented such that one or more nubs 106 of the inner core 104 are fit into one or more cutouts 118 in the flange 114.

At step 710, the first hemisphere 108 can be fit over the inner core 104 and be coupled with the second hemisphere 110 to enclose the inner core 104 within the outer shell 102. In some embodiments a flange 114 of the second hemisphere 110 can be inserted into a flange indentation 116 in the first hemisphere 108, around the inner core 104. In some embodiments surfaces of the peripheral edges 112, the flange 114, and/or the flange indentation 116 that will directly touch corresponding surface on the other hemisphere can be coupled with adhesives or a bonding agent, such as contact cement. In some embodiments, the surfaces can be roughened with sandpaper, a file, or any other device, or be primed with a liquid primer, before the adhesive or bonding agent is applied. The adhesives or bonding agent can be allowed to cure and/or dry.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A method of manufacturing a sports ball, comprising:

forming a first hemisphere from cross-linked closed-cell foam such that said first hemisphere has a concave dome shape defining a first partial inner cavity, and has a flange indentation proximate to a circular peripheral edge of said first hemisphere;

forming a second hemisphere from cross-linked closed-cell foam such that said second hemisphere has a concave dome shape defining a second partial inner cavity, and has a flange extending from a circular peripheral edge of said second hemisphere;

forming an inner core having a spherical shape;

placing said inner core within said second partial inner cavity of said second hemisphere and within said flange; and coupling the circular peripheral edge of said first hemisphere with the circular peripheral edge of said second hemisphere, such that said first hemisphere and said second hemisphere together form an outer shell that encloses said inner core within an inner cavity formed by said first partial inner cavity and said second partial inner cavity;

wherein said inner core is formed with a plurality of nubs extending from its exterior surface, such that said nubs directly contact inner surfaces of said outer shell's interior cavity when said inner core is housed within said outer shell.

2. The method of claim 1, wherein said cross-linked closed-cell foam is ethylene-vinyl acetate foam.

3. The method of claim 1, wherein said inner core is formed from rubber.

4. The method of claim 1, wherein said first hemisphere and said second hemisphere are coupled together with a bonding agent.

5. The method of claim 4, wherein the circular perimeter edges of said first hemisphere and said second hemisphere are roughened prior to applying said bonding agent.

6. The method of claim 1, further comprising forming one or more lines comprising a plurality of raised protrusions on the exterior surface of said first hemisphere and said second hemisphere, said one or more lines being parallel to the circular perimeter edges of said first hemisphere and said second hemisphere.

* * * * *